US009260926B2

(12) United States Patent
Givens et al.

(10) Patent No.: US 9,260,926 B2
(45) Date of Patent: Feb. 16, 2016

(54) SEAL STEM

(71) Applicant: Weatherford/Lamb, Inc., Houston, TX (US)

(72) Inventors: George Givens, Spring, TX (US); Rocky A. Turley, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 376 days.

(21) Appl. No.: 13/837,881

(22) Filed: Mar. 15, 2013

(65) Prior Publication Data

US 2013/0292138 A1 Nov. 7, 2013

Related U.S. Application Data

(60) Provisional application No. 61/642,340, filed on May 3, 2012.

(51) Int. Cl.

| | |
|---|---|
| ***E21B 33/12*** | (2006.01) |
| ***E21B 17/08*** | (2006.01) |
| ***E21B 43/10*** | (2006.01) |

(52) U.S. Cl.

CPC ..... *E21B 17/08* (2013.01); *E21B 33/1208* (2013.01); *E21B 43/10* (2013.01)

(58) Field of Classification Search

CPC ..... E21B 33/12; E21B 43/10

See application file for complete search history.

(56) References Cited

U.S. PATENT DOCUMENTS

| | | | | |
|---|---|---|---|---|
| 2,125,665 A | | 8/1938 | Bettis | |
| 2,652,894 A | | 9/1953 | Brown et al. | |
| 3,147,016 A | | 9/1964 | Traufler | |
| 3,215,208 A | | 11/1965 | Tamplen | |
| 3,227,462 A | | 1/1966 | Tamplen | |
| 3,278,192 A | | 10/1966 | Tamplen | |
| 3,333,692 A | | 8/1967 | Etal | |
| 3,374,838 A | | 3/1968 | Current | |
| 3,631,926 A | | 1/1972 | Young | |
| 3,784,214 A | | 1/1974 | Tamplen | |
| 4,083,408 A | | 4/1978 | Milam | |
| 4,379,558 A | | 4/1983 | Pippert | |
| 4,482,086 A | | 11/1984 | Wagner et al. | |
| 4,588,029 A | | 5/1986 | Blizzard | |
| 4,601,343 A | * | 7/1986 | Lindsey et al. | 166/382 |
| 4,753,444 A | | 6/1988 | Jackson et al. | |

(Continued)

FOREIGN PATENT DOCUMENTS

| | | |
|---|---|---|
| EP | 2169177 A1 | 3/2010 |
| GB | 2427631 A | 1/2007 |

(Continued)

OTHER PUBLICATIONS

PCT International Search Report and Written Opinion dated Feb. 27, 2014, for International Application No. PCT/US2013/039417.

(Continued)

*Primary Examiner* — William P Neuder

(74) *Attorney, Agent, or Firm* — Patterson & Sheridan, LLP

(57) ABSTRACT

In one embodiment, the sealing apparatus includes a mandrel having at least two portions, a first portion having a seal ring disposed on an exterior surface and a second portion without a seal ring disposed on an exterior surface. In one embodiment, the seal ring is disposed around the first portion. In another embodiment, the burst and collapse integrity of the first portion is substantially the same as the second portion.

27 Claims, 6 Drawing Sheets

(56) References Cited

U.S. PATENT DOCUMENTS

| | | | | |
|---|---|---|---|---|
| 4,809,989 | A | 3/1989 | Kernal | |
| 4,942,925 | A | 7/1990 | Themig | |
| 5,052,483 | A | 10/1991 | Hudson | |
| 5,076,356 | A | 12/1991 | Reimert | |
| 5,221,063 | A * | 6/1993 | Wafer et al. | 251/330 |
| 5,311,938 | A | 5/1994 | Hendrickson et al. | |
| 5,330,001 | A | 7/1994 | Baugh et al. | |
| 5,355,961 | A | 10/1994 | Gariepy et al. | |
| 5,433,269 | A | 7/1995 | Hendrickson | |
| 5,462,121 | A | 10/1995 | Schmuck et al. | |
| 5,467,822 | A | 11/1995 | Zwart | |
| 5,511,620 | A | 4/1996 | Baugh et al. | |
| 5,603,511 | A | 2/1997 | Keyser, Jr. et al. | |
| 5,685,369 | A | 11/1997 | Ellis et al. | |
| 5,791,657 | A | 8/1998 | Cain et al. | |
| 5,857,520 | A | 1/1999 | Mullen et al. | |
| 6,123,148 | A | 9/2000 | Oneal | |
| 6,142,227 | A | 11/2000 | Hiorth et al. | |
| 6,409,175 | B1 | 6/2002 | Evans et al. | |
| 6,425,444 | B1 | 7/2002 | Metcalfe et al. | |
| 6,446,717 | B1 | 9/2002 | White et al. | |
| 6,666,276 | B1 | 12/2003 | Yokley et al. | |
| 6,691,789 | B2 | 2/2004 | Jackson et al. | |
| 6,705,615 | B2 | 3/2004 | Milberger et al. | |
| 6,763,893 | B2 | 7/2004 | Braddick | |
| 6,769,491 | B2 | 8/2004 | Zimmerman et al. | |
| 6,772,844 | B2 | 8/2004 | Lloyd et al. | |
| 6,789,622 | B1 | 9/2004 | Ducasse et al. | |
| 6,814,143 | B2 | 11/2004 | Braddick | |
| 6,902,008 | B2 | 6/2005 | Hirth et al. | |
| 6,962,206 | B2 | 11/2005 | Hirth et al. | |
| 7,036,581 | B2 | 5/2006 | Trahan | |
| 7,165,622 | B2 | 1/2007 | Hirth et al. | |
| 7,172,029 | B2 | 2/2007 | Hirth et al. | |
| 7,213,814 | B2 | 5/2007 | Hurlbert et al. | |
| 7,225,880 | B2 | 6/2007 | Braddick | |
| 7,234,533 | B2 | 6/2007 | Gambier | |
| 7,252,142 | B2 | 8/2007 | Brezinski et al. | |
| 7,322,422 | B2 | 1/2008 | Patel | |
| 7,360,592 | B2 | 4/2008 | McMahan | |
| 7,367,404 | B2 | 5/2008 | Simpson et al. | |
| 7,370,708 | B2 | 5/2008 | Simpson et al. | |
| 7,380,592 | B2 | 6/2008 | Atkins et al. | |
| 7,387,170 | B2 | 6/2008 | Doane et al. | |
| 7,407,165 | B1 | 8/2008 | Chisnell | |
| 7,441,606 | B2 | 10/2008 | Maguire | |
| 7,469,750 | B2 | 12/2008 | Carr | |
| 7,493,945 | B2 | 2/2009 | Doane et al. | |
| 7,665,532 | B2 | 2/2010 | Cook et al. | |
| 7,703,542 | B2 | 4/2010 | O'Connor et al. | |
| 7,740,248 | B2 | 6/2010 | Keene et al. | |
| 7,748,467 | B2 | 7/2010 | Doane | |
| 7,766,088 | B2 | 8/2010 | Saucier et al. | |
| 7,775,290 | B2 | 8/2010 | Brisco et al. | |
| 7,779,927 | B2 | 8/2010 | Turley et al. | |
| 7,784,797 | B2 | 8/2010 | Baugh et al. | |
| 7,921,921 | B2 | 4/2011 | Bishop et al. | |
| 8,066,065 | B2 | 11/2011 | Buckner | |
| 8,109,340 | B2 | 2/2012 | Doane et al. | |
| 8,459,347 | B2 | 6/2013 | Stout | |
| 8,997,882 | B2 | 4/2015 | Turley et al. | |
| 2002/0088616 | A1 | 7/2002 | Swor et al. | |
| 2002/0121380 | A1 | 9/2002 | Doane et al. | |
| 2002/0148612 | A1 | 10/2002 | Cook et al. | |
| 2004/0060706 | A1 | 4/2004 | Stephenson | |
| 2004/0123983 | A1 | 7/2004 | Cook et al. | |
| 2005/0172472 | A1 | 8/2005 | Verger et al. | |
| 2005/0173110 | A1 | 8/2005 | Trahan | |
| 2006/0186602 | A1 | 8/2006 | Martin et al. | |
| 2006/0272827 | A1 | 12/2006 | Adam et al. | |
| 2007/0151725 | A1 | 7/2007 | Cook et al. | |
| 2008/0277120 | A1 * | 11/2008 | Hickie | 166/308.1 |
| 2008/0289813 | A1 | 11/2008 | Gewily et al. | |
| 2009/0205843 | A1 | 8/2009 | Gandikota et al. | |
| 2010/0089591 | A1 | 4/2010 | Thomson et al. | |
| 2011/0037230 | A1 | 2/2011 | O'Connor et al. | |
| 2012/0205091 | A1 * | 8/2012 | Turley | E21B 33/1216 166/77.53 |
| 2012/0205092 | A1 | 8/2012 | Givens et al. | |
| 2012/0205872 | A1 | 8/2012 | Reinhardt et al. | |
| 2012/0205873 | A1 | 8/2012 | Turley | |
| 2013/0269956 | A1 | 10/2013 | Yee | |
| 2013/0292138 | A1 | 11/2013 | Givens et al. | |

FOREIGN PATENT DOCUMENTS

| | | |
|---|---|---|
| RU | 1367586 | 11/1996 |
| WO | 2005040547 A1 | 5/2005 |
| WO | 2010083132 A1 | 7/2010 |
| WO | 2011083066 A1 | 7/2011 |

OTHER PUBLICATIONS

Baker Hughes Tieback Seal Assemblies p. 83 from catalog date unknown.

* cited by examiner

SEAL STEM

BACKGROUND OF THE INVENTION

1. Field of the Invention

Embodiments of the present invention generally relate to a downhole seal arrangement. More particularly, embodiments of the present invention relate to seal stem arrangement for reconnecting with a tubular.

2. Description of the Related Art

During the life of a well, an operator may decide to reconnect to a liner. One method is to insert a tie back string having a seal stem at a lower end for establishing pressure integrity with a liner. FIG. 1 shows a seal stem disposed inside a polish bore receptacle 3 ("PBR") of the liner. The seal stem includes a mandrel 10 and three assemblies 11, 12, 13 of Chevron-type seal rings disposed on a reduced diameter portion of the mandrel 10. Each assembly 11, 12, 13 includes upper and lower travel stops 14, 16 attached to the mandrel 10. Two stacks of oppositely facing Chevron-type seal rings 21, 23 are disposed between the travel stops 14, 16. As shown, a stack of upwardly oriented seal rings 21 and a stack of downwardly oriented seal rings 22 are disposed on each side of an o-ring 23. Each stack may include as many as twenty seal rings 21, 22 to provide adequate sealing with the PBR. The Chevron seal rings 21, 22 are oriented in opposite directions to seal against differential pressures in either direction.

One of the drawbacks of this design is a reduced diameter portion 8 is created to accommodate the seal assemblies 11, 12, 13. The reduced diameter portion 8 decreases the burst and collapse integrity of the mandrel 10. Another drawback is one or more of the seals may roll off the seal stem during insertion, removal, or circulation.

There is a need, therefore, for a seal arrangement that does not require a compromise of the integrity of the seal stem. There is also a need for a seal stem for reconnecting with a tubular without concerns of the seal rolling off the seal stem.

SUMMARY OF THE INVENTION

In one embodiment, the sealing apparatus includes a mandrel having at least two portions; a first portion having a seal ring disposed on an exterior surface and a second portion without a seal ring disposed on an exterior surface. In one embodiment, the burst and collapse integrity of the first portion is substantially the same as the second portion. In another embodiment, the seal ring is disposed around the first portion.

In one embodiment, a sealing apparatus for sealing against a tubular in the wellbore includes a mandrel having a gland; a seal ring disposed in the gland for engaging the tubular; and one or more seal bands disposed in the seal ring. In another embodiment, the tubular comprises a PBR. In yet another embodiment, the gland comprises a groove formed in an outer surface of the mandrel.

In another embodiment, a method of connecting to a tubular in a wellbore includes providing a sealing apparatus having a mandrel having at least two portions, wherein the first portion includes a seal ring disposed on an exterior surface and the second portion without a seal ring disposed on an exterior surface, and wherein a burst integrity of the first portion is substantially the same as the second portion. In one embodiment, the method includes engaging the seal ring to an interior of the tubular and redistributing a portion of the seal ring along a gap between the mandrel and the tubular.

In another embodiment, a method of connecting to a tubular in a wellbore includes providing a sealing apparatus having a mandrel having a gland; a seal ring disposed in the gland for engaging the tubular; and one or more seal bands disposed in the seal ring. The method also includes engaging the seal ring to an interior of the tubular, and redistributing a portion of the seal ring along a gap between the mandrel and the tubular, thereby forming a seal with the tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to a seal assembly for a downhole tool. The seal assembly will be described herein in relation to a seal stem for reconnecting to a tubular such as a liner. It is to be understood, however, that the seal assembly may also be used with other downhole tools. Further, the seal assembly may be used in a downhole tool that is disposed within a cased wellbore or within an open-hole wellbore.

In one embodiment, a seal assembly includes a mandrel having one or more grooves formed on an outer surface. An extrusion resistant seal ring is disposed in each of the grooves. The seal ring may be used to form a seal with a tubular in the wellbore.

Figure 1:
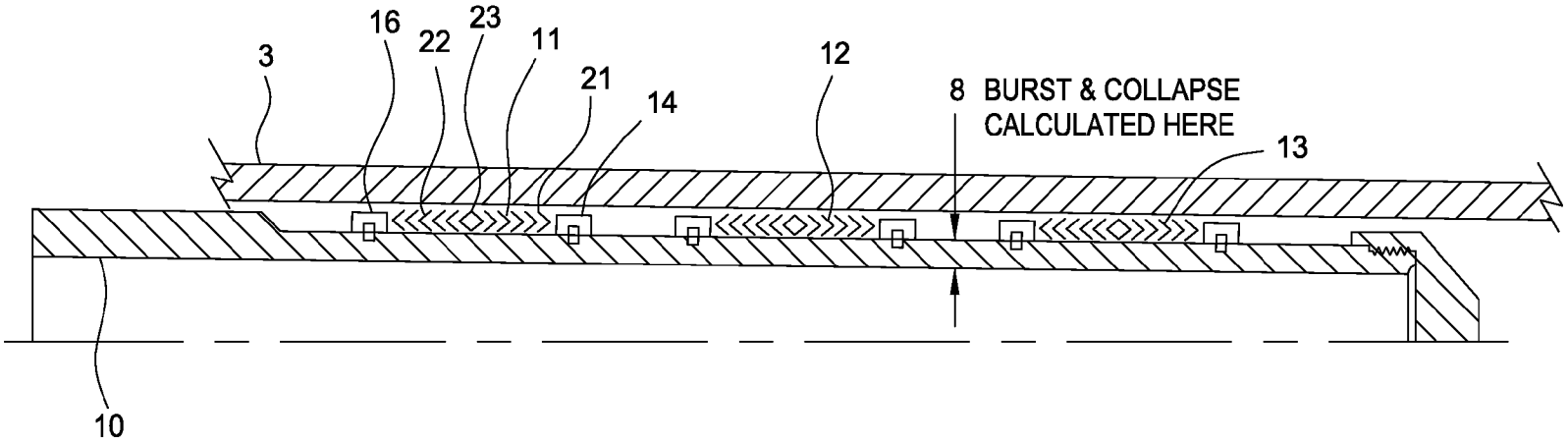
FIG. 1 (PRIOR ART)
FIG. 1 illustrates a seal stem in the prior art.
Figure 2:
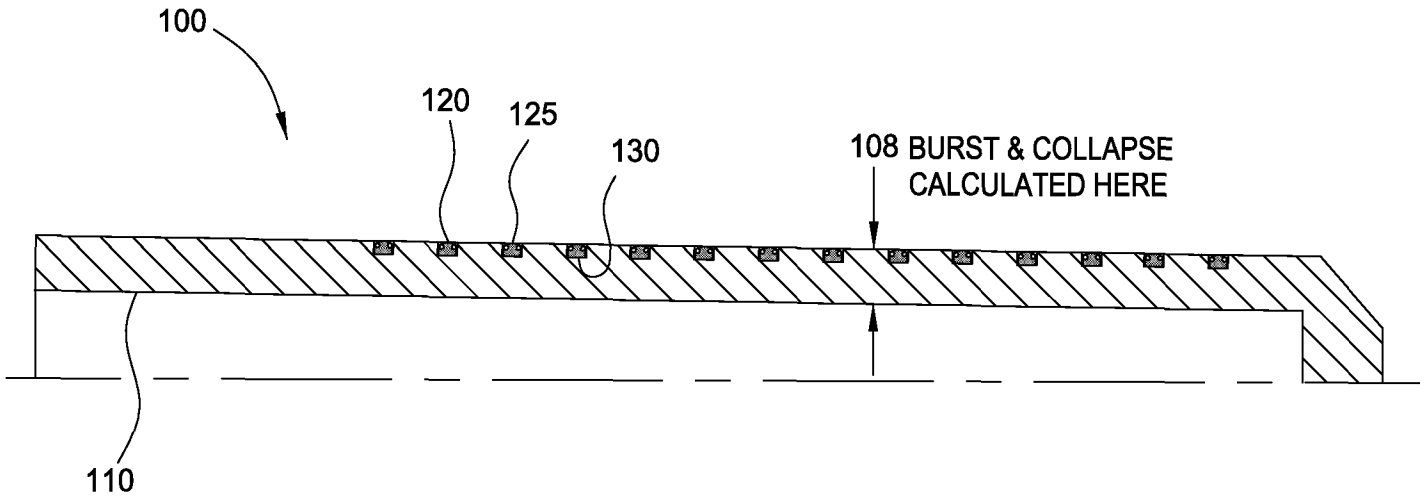
FIG. 2 illustrates an embodiment of a seal stem.

FIG. 2 illustrates an embodiment of a seal stem 100. The seal stem 100 may be a tubular connected to a tubular string (not shown) such as a tubing string. In another embodiment, the seal stem 100 may be integral with the tubular string. The seal stem 100 includes a mandrel 110 and one or more seal assemblies. The seal stem 100 may be adapted to form a seal with a tubular in the wellbore. For example, the seal stem 100 may engage a precise bore tubular such as a polish bore receptacle ("PBR"). In one embodiment, the precise bore tubular may include a tubular having a bore machined to a smooth finish, to a predetermined diameter, or both. Although embodiments described below make reference to a PBR, it is contemplated that the seal stem 100 may engage other tubulars in the wellbore.

Figure 3:
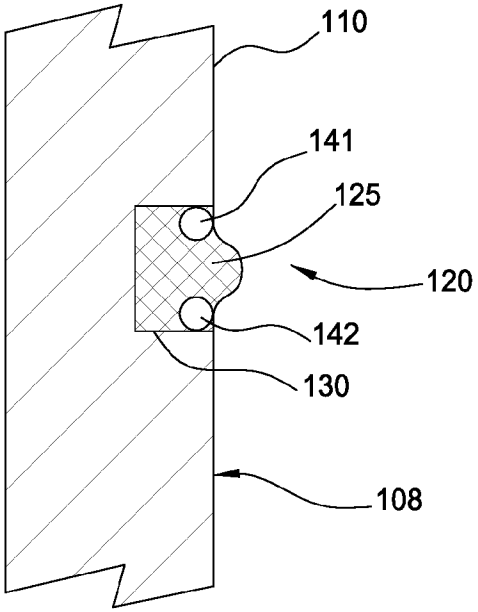
FIG. 3 illustrates an enlarged partial view of the seal stem of FIG. 2.

The seal stem 100 may include any suitable number of seal assemblies 120 to create a seal between mandrel 110 and the PBR. FIG. 3 is an enlarged view of an exemplary seal assembly 120. The seal assembly 120 includes a seal ring 125 disposed in a gland 130. In one embodiment, the gland 130 may be a circumferential groove formed in the outer surface of the mandrel 110. Because the wall thickness of the mandrel 110 on each side of the seal ring 125 is retained, as indicated by reference number 108, the burst and/or collapse properties of the mandrel 110 remain substantially the same. In one embodiment, the seal assemblies 120 may be molded and bonded to the gland 120. A bonding material, such as glue, fastener, or other attachment means, may optionally be used to attach the seal ring 125 to the gland 130. Bonding the seal ring 125 in the gland 130 is useful to prevent the seal ring 125 from becoming unstable and swab off during movement of the seal stem 100. The seal ring 125 may include an elastomeric material such as poly ether ketone ("PEEK"), polytetrafluoroethylene ("PTFE"), and combinations thereof. Additionally, a volume gap (not shown) may be created between the seal ring 125 and a side of the gland 130. The volume gap is configured to substantially prevent distortion of the seal ring 125 as the seal stem 100 is being inserted into the PBR 162.

The seal ring 125 includes one or more anti-extrusion bands, such as a first seal band 141 (first anti-extrusion band) and a second seal band 142 (second anti-extrusion band). As shown, the seal bands 141, 142 are embedded in the seal ring 125 in an upper corner of each side of the seal ring 125. In one embodiment, the seal bands 141, 142 are disposed on an outer circumference of the seal ring 125. In another embodiment, the seal bands may be a non-elastomeric anti-extrusion band for supporting high pressure. In yet another embodiment, the seal bands 141, 142 are springs, such as toroidal coil springs. The seal bands 141, 142 may be used to limit the extrusion of the seal ring 125 during expansion of the seal assembly 120. The seal bands 141, 142 may also be used to limit the extrusion of applied differential pressure after expansion of the seal assembly 120.

Figure 4:
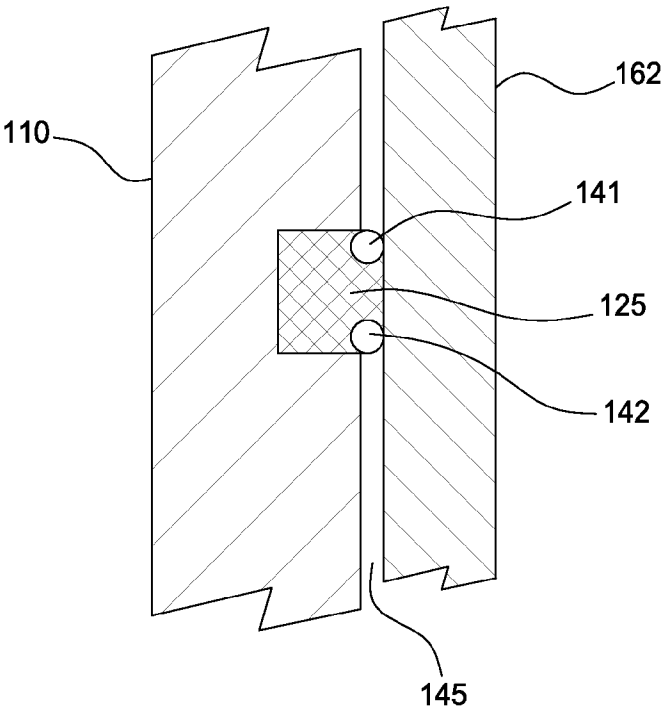
FIG. 4 illustrates an enlarged view of the seal stem after engagement with a tubular.

FIG. 4 shows the seal stem 100 engaged with the PBR 162. When the seal ring 125 initially engages the PBR 162, the seal ring 125 changes its configuration and occupies a portion of the gap 145 between the mandrel 110 and the PBR 162. As shown in FIG. 3, the seal ring 125 includes a protrusion for contact with the PBR 162. The protrusion may be any suitable shape such as an arcuate shape, a contour, or double protrusion. In one embodiment, the protrusion has a height above the mandrel 110 that is more than the distance of the gap 145. Engagement with the PBR 162 causes the elastomeric material of the seal ring 125 to redistribute along the gap 145 between mandrel 110 and the PBR 162. In addition, at least a portion of the anti-extrusion bands 141, 142 is forced outwardly toward the gap 145 due to the redistribution of the seal ring material. In this position, the seal bands 141, 142 act as barriers to substantially prevent the extrusion of the seal ring 125 into the gap 145 beyond the seal bands 141, 142. In one embodiment, the seal bands 141, 142 are springs, such as toroidal coil springs, which expand radially outward into the gap 145 due to the redistribution of the elastomeric material. As the springs expand radially outward, the coils of spring act as a barrier to the flow of the elastomeric material of the seal ring 125. In this manner, the seal bands 141, 142 in the seal ring 125 act as an anti-extrusion barriers.

Embodiments of the seal assemblies 120 described herein provide several advantages over the prior art. For example, by preventing extrusion of the seal ring 125, the seal bands 141, 142 retain the seal ring 125 in an energized state to create a high-pressure seal between the seal assembly 120 and the PBR 162. In one embodiment, the seal assembly 120 may create a high-pressure seal in the range of 12,000 to 14,000 psi. Another potential benefit is the seal assembly 120 does not require the mandrel 110 to include a reduced diameter portion to accommodate the seal assembly. As a result, the mandrel 110 has a higher burst and collapse property.

Figure 5:
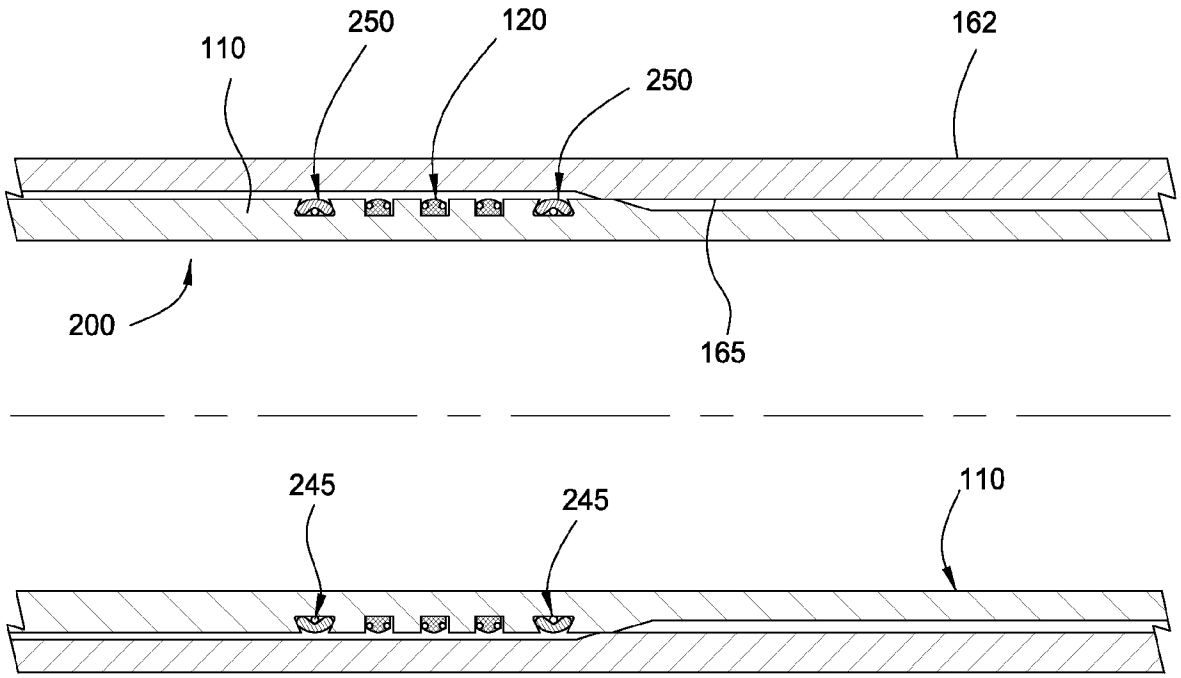
FIG. 5 illustrates an embodiment of a seal stem.

FIG. 5 illustrates an embodiment of a seal stem 200. For convenience, the components in the seal stem 200 that are similar to the components in the seal stem 100 will be labeled with the same reference number. The seal stem 200 includes the mandrel 110 and the seal assemblies 120. Each seal assembly 120 may include the first seal band 141 (first anti-extrusion band) and the second seal band 142 (second anti-extrusion band) as described herein.

Figure 6:
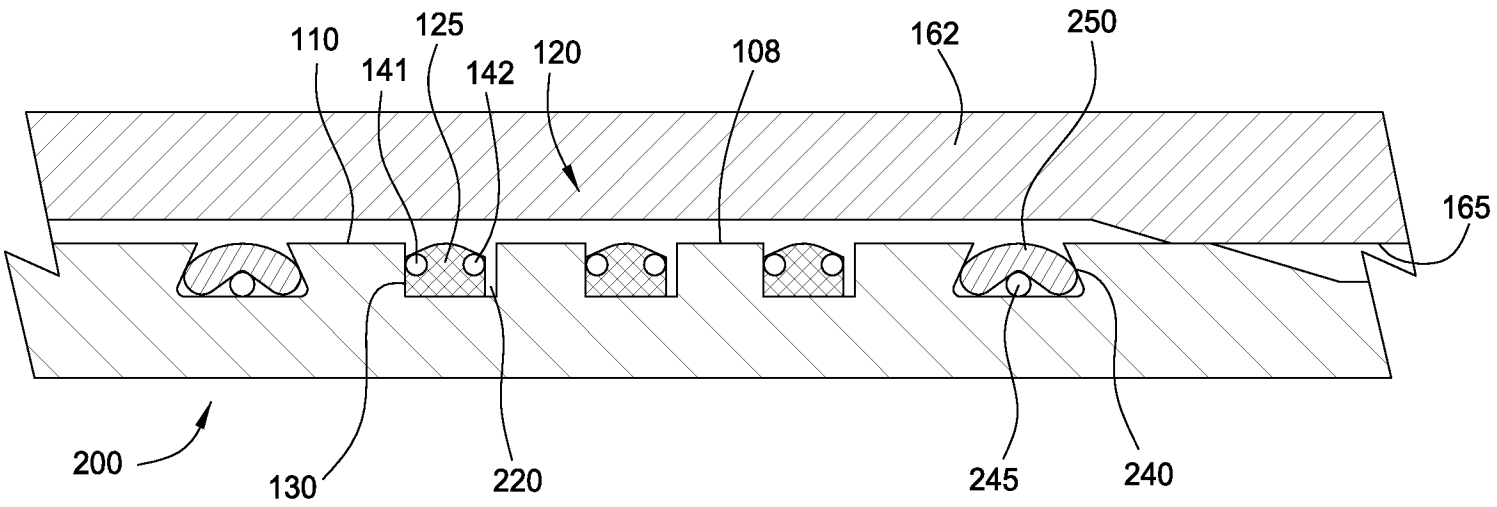
FIG. 6 illustrates an enlarged partial view of the seal stem of FIG. 5.

As shown in FIG. 5, the seal stem 200 includes a wiper ring 250 disposed adjacent each end of the seal assemblies 120. The wiper ring 250 is configured to wipe (or clean) an inner surface 165 of the PBR 162 as the wiper ring 250 contacts and slides along the inner surface 165 when the seal stem 200 is inserted into the PBR 162. As a result, a clean surface is provided for the seal assemblies 120 when the seal stem 200 is engaged with the PBR 162. An optional o-ring 245 may be placed under the wiper ring 250. The o-ring 245 is configured to act as a stiffener under the wiper ring 250. In other words, the o-ring 245 stiffens the wiper ring 250 by supporting a portion of the wiper ring 250. As shown in FIG. 6, the wiper ring 250 is disposed in a gland 240. In one embodiment, the gland 240 may be a circumferential groove formed in the outer surface of the mandrel 110. The gland 240 is shaped so as to provide support to the wiper ring 250 as the wiper ring 250 cleans the inner surface 165 of the PBR 162.

As shown in FIG. 6, a volume gap 220 is created between the seal ring 125 and a side of the gland 130. Generally, the volume gap 220 is used to substantially prevent distortion of the seal ring 125 as the seal stem 200 is being inserted into the PBR 162. The volume gap 220 is a free-space (empty space, clearance or void) between a portion of the seal ring 125 and a portion of the gland 130 prior to the insertion of the seal stem 200 into the PBR 162. In other words, during the fabrication process of the seal stem 200, the volume gap 220 is created by positioning the seal ring 125 within the gland 130 such that the seal ring 125 is spaced apart from at least one side of the gland 130. Even though the volume gap 220 in FIG. 6 is created by having a side of the gland 130 arranged parallel to the a side of the seal ring 125, the volume gap 220 may be created in any configuration, such as positioned at an angle, without departing from principles of the present invention. Additionally, the size of the volume gap 220 may vary depending on the configuration of the gland 130. In one embodiment, the gland 130 has 3-5% more volume due to the volume gap 220 than a standard gland without a volume gap.

During the insertion of the seal stem 200 into the PBR 162, the seal ring 125 moves into contact with the inner surface 165 of the PBR 162 to create a seal between the seal stem 200 and the PBR 162. As the seal ring 125 contacts the inner surface 165 of the PBR 162, the seal ring 125 changes configuration and occupies a portion of the volume gap 220. In one embodiment, the volume gap 220 is located on the side of the seal assembly 120 which is the first portion to be in contact with the inner surface 165 of the PBR 162. The location of the volume gap 220 in the seal assembly 120 allows the seal ring 125 to change position (or reconfigure) within the gland 130 during the insertion operation. Additionally, the volume of the volume gap 220 may change during the insertion operation.

Figure 7:
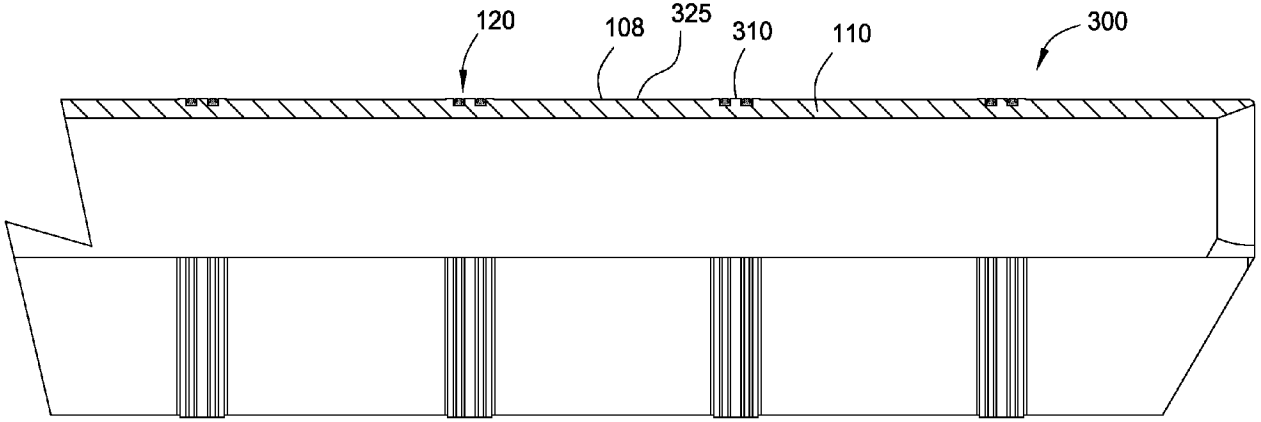
FIG. 7 illustrates an embodiment of a seal stem.

FIG. 7 illustrates an embodiment of a seal stem 300. For convenience, the components in the seal stem 300 that are similar to the components in the seal stems 100, 200 will be labeled with the same reference number. As shown, the seal stem 300 includes multiple sets of seal assemblies 120 on the mandrel 110. Each set includes two seal assemblies 120. It should be understood, however, that each set may include any number of seal assemblies, without departing from principles of the present invention.

Figure 8:
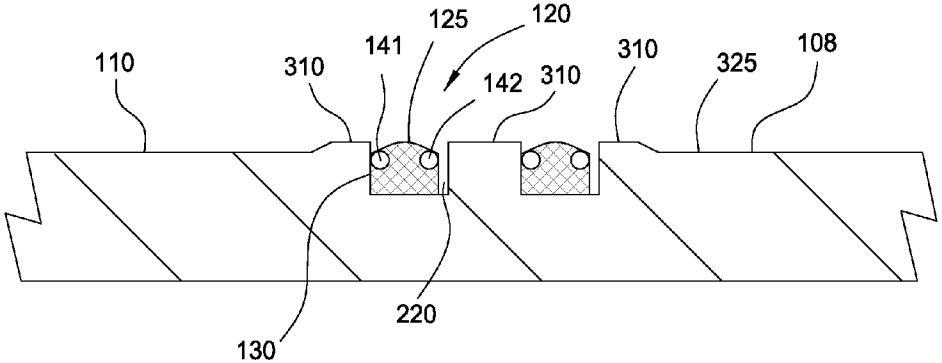
FIG. 8 illustrates an enlarged partial view of the seal stem of FIG. 7.

FIG. 8 illustrates an enlarged partial view of the seal stem 300 of FIG. 7. As shown, the seal ring 125 includes one or more anti-extrusion bands, such as the first seal band 141 (first anti-extrusion band) and the second seal band 142 (second anti-extrusion band). The seal bands 141, 142 are embedded in the seal ring 125 in an upper corner of each side of the seal ring 125. The seal ring 125 is disposed in the gland 130. Additionally, the volume gap 220 may be created between the seal ring 125 and the side of the gland 130. The volume gap is configured to substantially prevent distortion of the seal ring 125 as the seal stem 300 is being inserted into the PBR (not shown).

The mandrel 110 has a first outer diameter 325 between each set of seal assemblies 120 and a second outer diameter 310 at the seal assemblies 120. The first outer diameter 325 is smaller than the second outer diameter 310. In other words, the mandrel 110 has a greater wall thickness (see reference number 310) at the seal assemblies 120 as compared to the wall thickness (see reference number 325) between each set of seal assemblies 120. The increased wall thickness at the seal assemblies 120 provides support to the seal assemblies 120 as the seal stem 300 is being inserted into the PBR (not shown). Further, the increased wall thickness at the seal assemblies 120 minimizes the gap (reference number 145 on FIG. 4) between the mandrel 110 and the PBR. As a result, the smaller gap may be used to limit the extrusion of the seal ring 125 as the seal stem 300 is being inserted into the PBR. The smaller gap may also be used to limit the extrusion of the seal ring 125 when the seal assemblies 120 are subjected to high differential pressure after the seal stem 300 has been inserted into the PBR. In other words, the seal assemblies 120 will be able to withstand a higher differential pressure above and/or below the seal assemblies 120 with the smaller gap, as described herein, as compared to seal assemblies that do not have the smaller gap. Moreover, the smaller diameter 325 between each set of seal assemblies 120 increases the clearance between the seal stem 300 and the PBR along a substantial portion of the seal stem 300. The increased clearance between the seal stem 300 and the PBR minimizes the risk of the seal stem 300 of becoming stuck (or jammed) when the seal stem 300 is being inserted into the PBR.

In one embodiment, the sealing apparatus includes a mandrel having at least two portions, a first portion having a seal ring disposed on an exterior surface and a second portion without a seal ring disposed on an exterior surface. In one embodiment, the seal ring is disposed around the first portion. In another embodiment, the burst and collapse integrity of the first portion is substantially the same as the second portion.

In one embodiment, a sealing apparatus for sealing against a tubular in the wellbore includes a mandrel having a gland; a seal ring disposed in the gland for engaging the tubular, wherein a wall thickness of the mandrel on each side of the gland is substantially the same; and one or more seal band disposed in the seal ring. In another embodiment, the tubular comprises a PBR. In yet another embodiment, the gland comprises a groove formed in an outer surface of the mandrel. In yet another embodiment, wherein the mandrel includes two glands, and a wall thickness of the mandrel at one of the glands is less than a wall thickness between the two glands.

While the foregoing is directed to embodiments of the present invention, other and further embodiments of the invention may be devised without departing from the basic scope thereof, and the scope thereof is determined by the claims that follow.

The invention claimed is:

1. A sealing apparatus for sealing against a tubular in a wellbore, comprising:

a mandrel having at least two portions, wherein the first portion includes a seal ring disposed on an exterior surface and the second portion without a seal ring disposed on an exterior surface, and wherein the seal ring is disposed in a gland of the first portion, a first band is embedded in the seal ring, the first band is within the gland at a first position, and at least a portion of the first band and a portion of the seal ring are out of the gland at a second position.

2. The sealing apparatus of claim 1, wherein the seal ring is disposed around the first portion.

3. The sealing apparatus of claim 1, wherein the tubular comprises a polish bore receptacle.

4. The sealing apparatus of claim 1, wherein the first band is a spring.

5. The sealing apparatus of claim 1, wherein the first band comprises a non-elastomeric anti-extrusion band.

6. The sealing apparatus of claim 1, wherein the seal ring includes a protrusion for contacting the tubular.

7. The sealing apparatus of claim 6, further comprising a second band embedded in the seal ring, wherein the protrusion is between the first band and the second band.

8. The sealing apparatus of claim 1, wherein the first band moves from the first position to the second position while the seal ring redistributes in a gap between the mandrel and the tubular.

9. The sealing apparatus of claim 1, wherein a burst integrity of the first portion is substantially the same as the second portion.

10. The method of claim 1, wherein a burst integrity of the first portion is substantially the same as the second portion.

11. A method of connecting to a tubular in a wellbore, comprising:

providing a sealing apparatus having:

a mandrel having at least two portions, wherein the first portion includes a seal ring disposed on an exterior surface and the second portion without a seal ring disposed on an exterior surface, and wherein the seal ring is disposed in a gland of the first portion, a band is embedded in the seal ring, the band is disposed within the gland in a first position, and at least a portion of the band and a portion of the seal ring are out of the gland at a second position;

engaging the seal ring to an interior of the tubular; and moving the seal ring and the band from the first position to the second position by redistributing a portion of the seal ring along a gap between the mandrel and the tubular while urging at least a portion of the band out of the gland and into the gap.

12. The method of claim 11, wherein the tubular comprises a precise bore tubular.

13. The method of claim 12, wherein the precise bore tubular comprises a polish bore receptacle.

14. A sealing apparatus for sealing against an inner surface of a tubular in a wellbore, comprising:

a mandrel having a first groove and a second groove;

a seal ring disposed in the first groove, the seal ring having one or more anti-extrusion bands embedded within the seal ring, the seal ring being configured to engage the inner surface of the tubular;

a wiper ring disposed in the second groove, the wiper ring being configured to wipe the inner surface of the tubular prior to the seal ring engaging the inner surface of the tubular; and an o-ring disposed in the second groove between the wiper ring and a bottom wall of the second groove.

15. The sealing apparatus of claim 14, wherein a volume gap is defined between a side of the first groove and a side of the seal ring.

16. The sealing apparatus of claim 15, wherein the volume gap is configured to close when the seal ring engages the inner surface of the tubular.

17. The sealing apparatus of claim 16, wherein the volume gap is closed by filling the volume gap with a portion of the seal ring.

18. The sealing apparatus of claim 14, wherein the o-ring is configured to provide support to the wiper ring.

19. The sealing apparatus of claim 14, wherein the seal ring includes a protrusion for contacting the inner surface of the tubular.

20. The sealing apparatus of claim 19, wherein the seal ring includes two anti-extrusion bands, and the protrusion is disposed between the two anti-extrusion bands.

21. A method of creating a seal between a first tubular and a second tubular, comprising:

positioning a portion of the first tubular within the second tubular, the first tubular having a seal ring disposed in a first groove and a wiper ring disposed over an o-ring disposed in a second groove, the seal ring having one or more anti-extrusion bands embedded within the seal ring;

cleaning an inner surface of the second tubular as the wiper ring contacts the inner surface of the second tubular; and creating the seal between the first tubular and the second tubular as the seal ring engages the inner surface of the second tubular.

22. The method of claim 21, wherein a volume gap is defined between a side of the first groove and a side of the seal ring.

23. The method of claim 22, further comprising closing the volume gap upon creating the seal between the first tubular and the second tubular.

24. A sealing apparatus for sealing against an inner surface of a tubular in a wellbore, comprising:

a mandrel having a first portion, a second portion, and a third portion, the second portion disposed between the first portion and the third portion, the second portion having a greater wall thickness than the first portion and the third portion;

a first ring disposed in a first groove formed in the second portion of the mandrel, the first ring having one or more anti-extrusion bands embedded within the first ring, the first ring being configured to engage the inner surface of the tubular; and a second ring disposed in a second groove formed in the second portion of the mandrel.

25. The sealing apparatus of claim 24, wherein a volume gap is defined between a side of the first groove and a side of the first ring, and wherein the volume gap is configured to close when the first ring engages the inner surface of the tubular.

26. The sealing apparatus of claim 24, further comprising an o-ring disposed between the second ring and a bottom surface of the second groove, wherein the second ring is configured to wipe the inner surface of the tubular.

27. The sealing apparatus of claim 24, wherein the second ring includes one or more anti-extrusion bands embedded with the second ring, and the second ring is configured to engage the inner surface of the tubular.

* * * * *